US006935149B1

(12) United States Patent
Peng et al.

(10) Patent No.: US 6,935,149 B1
(45) Date of Patent: Aug. 30, 2005

(54) ELECTRIC DOOR LOCK OPENABLE BY KEY

(76) Inventors: Fu Chang Peng, P.O.Box 10-69, Chong Ho, Taipei (TW) 235; Alan Liang, P.O.Box 10-69, Chong Ho, Taipei (TW) 235; Chih Hung Hsiao, P.O.Box 10-69, Chong Ho, Taipei (TW) 235

( * ) Notice: Subject to any disclaimer, the term of this patent is extended or adjusted under 35 U.S.C. 154(b) by 0 days.

(21) Appl. No.: 10/809,596

(22) Filed: Mar. 23, 2004

(51) Int. Cl.[7] ..... E05B 13/10

(52) U.S. Cl. ..... 70/472; 70/149; 70/189; 70/218; 70/224; 70/277

(58) Field of Search ..... 70/149, 218–224, 70/277, 279.1, 214, 278.7, 472, 188, 189, 70/422, 278.1, 278.2, 278.3; 292/DIG. 27

(56) References Cited

U.S. PATENT DOCUMENTS 3,176,754 A * 4/1965 Macios ..... 431/15
4,429,556 A * 2/1984 Kambic ..... 70/149
4,656,850 A * 4/1987 Tabata ..... 70/276
4,936,122 A * 6/1990 Osada ..... 70/214
5,027,629 A * 7/1991 Liu ..... 70/277
5,113,675 A * 5/1992 Uyeda ..... 70/477
5,447,047 A * 9/1995 Lin ..... 70/218
5,475,996 A * 12/1995 Chen ..... 70/279.1
5,934,117 A * 8/1999 Shen ..... 70/224
6,286,347 B1 * 9/2001 Frolov ..... 70/472
6,487,884 B1 * 12/2002 Constantinou ..... 70/277
6,640,594 B1 * 11/2003 Yao ..... 70/277

* cited by examiner

*Primary Examiner*—Lloyd A. Gall

(57) ABSTRACT

An electric door lock includes a handle rotatably attached to a housing, a lock device engaged in the housing, a follower rotatably secure the handle to the housing, an electromagnetic control device having a receptacle rotatably received in the follower, a plunger slidably engaged in the receptacle and extendible out of the receptacle to engage with the follower, and a latching device for selectively latching the plunger to the receptacle. The plunger may be selectively actuated to engage with the follower either by the lock device and correct keys or by the electromagnetic control device with correctly entered passwords or secret codes.

19 Claims, 10 Drawing Sheets

ELECTRIC DOOR LOCK OPENABLE BY KEY

BACKGROUND OF THE INVENTION

1. Field of the Invention

The present invention relates to an electric door lock, and more particularly to an electric door lock capable of being selectively opened by keys or by entering the correct passwords or secret codes into control circuits of the electric door locks.

2. Description of the Prior Art

Various kinds of typical electric door locks have been developed for locking doors of house buildings, and comprise a number of buttons for entering passwords or secret codes to open the typical electric door locks.

Normally, the typical electric door locks may only be opened by entering the correct passwords or secret codes into the control circuits of the typical electric door locks. Otherwise, the typical electric door locks may not be opened.

In some circumstances, the users may forget the passwords or the secret codes, and thus may not open the typical electric door locks, and may have to ask strong persons to open the typical electric door locks by forces or by breaking the door panels or the typical electric door locks.

The present invention has arisen to mitigate and/or obviate the afore-described disadvantages of the conventional electric door locks.

SUMMARY OF THE INVENTION

The primary objective of the present invention is to provide an electric door lock capable of being selectively opened by keys or by entering the correct passwords or secret codes into control circuits of the electric door locks.

In accordance with one aspect of the invention, there is provided an electric door lock comprising a housing, a handle rotatably attached to the housing, a lock device engaged in the housing, a follower received in the housing and secured to the handle, to rotatably secure the handle to the housing, an electromagnetic control device including a receptacle rotatably received in the follower, a plunger slidably engaged in the receptacle and extendible out of the receptacle to engage with the follower, and a latching device for selectively latching the plunger to the receptacle, and to maintain an engagement of the plunger with the follower, and to allow the receptacle of the electromagnetic control device to be selectively latched to the follower with the selectively latching device, and a connecting device for selectively connecting the lock device to the plunger, to selectively latch the plunger to the receptacle, and to allow the receptacle of the electromagnetic control device to be selectively latched to the follower with the selectively connecting device.

The follower includes a wall provided thereon and having a passage formed therein, the plunger is slidably engageable into the passage of the wall, to selectively anchor the plunger and the receptacle to the follower. A spring biasing device may further be provided for biasing the plunger to engage into the passage of the wall.

The plunger includes at least one inclined surface formed therein to engage with the wall, and to allow the plunger to be moved away from the wall against the biasing device with an engagement of the inclined surface of the plunger with the wall.

A coupler may further be provided and attached onto and rotated in concert with the receptacle of the electromagnetic control device, and a spindle attached to the coupler. The coupler includes a fence extended therefrom to receive the receptacle of the electromagnetic control device, and to couple the receptacle of the electromagnetic control device to the spindle, and the fence includes an opening formed therein to receive the plunger, and to allow the plunger to engage with the follower.

The receptacle of the electromagnetic control device includes a latch received therein and engageable into the plunger, to selectively latch the plunger to the receptacle, and an actuating device for actuating the latch to engage into the plunger and to latch the plunger to the receptacle.

The plunger includes a recess formed therein, to selectively receive the latch, and to allow the latch to be engaged into the recess of the plunger. The electromagnetic control device includes an electromagnetic member received in the plunger, and to be energized to attract the latch to engage into the recess of the plunger. The electromagnetic control device includes a control circuit board received in the receptacle and coupled to the electromagnetic member.

The handle includes a space formed therein and defined by a tube, a barrel rotatably received in the tube and actuatable and rotatable by the lock device, and a catch received in the barrel and movable to selectively engage into the plunger when the barrel is rotated relative to the tube by the lock device.

The barrel includes at least one projection extended therefrom, the lock device includes a core having at least one actuating finger extended therefrom, for engaging with the projection of the barrel, to selectively rotate the barrel relative to the tube.

The barrel includes a bar anchored therein and having the catch extended from the bar, and a guiding device for guiding the bar and the catch to move relative to the barrel, to selectively engage into the plunger when the barrel is rotated relative to the tube by the core of the lock device.

The guiding device includes an inclined channel formed in the barrel, and a higher seat and a lower seat formed in ends of the inclined channel of the barrel, the bar is slidably engaged with the inclined channel of the barrel and engageable in either of the higher seat and the lower seat of the barrel. The tube of the handle includes at least one slot formed therein, the bar includes at least one end engaged in the slot of the tube.

A spring biasing device may further be provided for biasing the bar to engage with the barrel. A further spring biasing device may further be provided for biasing the catch away from the plunger. The plunger includes a cavity formed therein to selectively receive the catch. The handle includes a casing, a block received in the casing and having the space formed therein to receive the lock device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
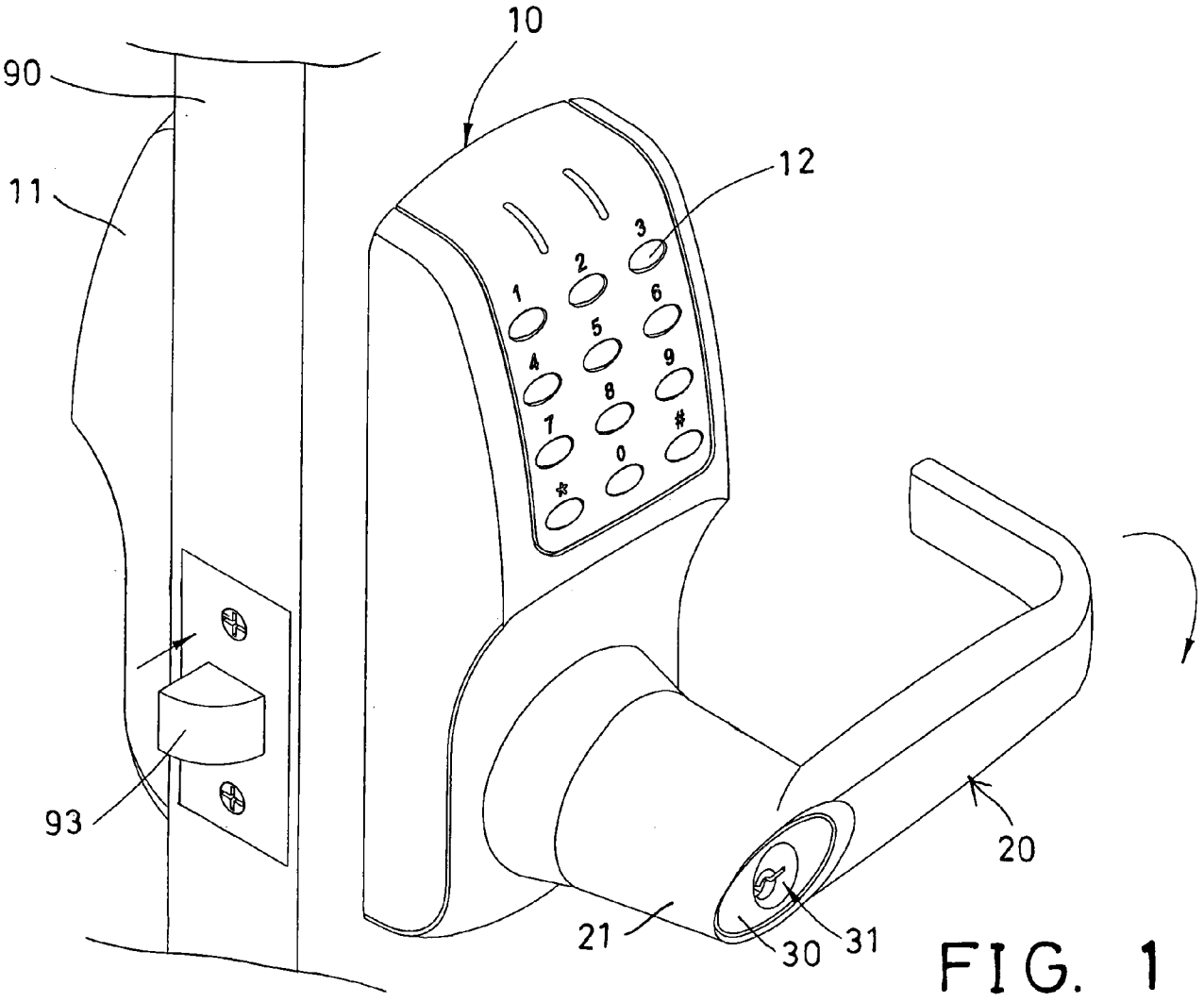
FIG. 1 is a partial perspective view illustrating an attachment of an electric door lock in accordance with the present invention to a door panel.

Referring to the drawings, and initially to FIGS. 1–4, an electric door lock in accordance with the present invention comprises two housings 10, 11 for attaching to outer and inner portions of a door panel 90, and two handles 20 rotatably attached to the housings 10, 11 respectively and coupled together with a typical spindle 91, to couple to and to actuate a typical latchbolt 93 (FIG. 1). The actuation of the latchbolt 93 with the spindle 91 is typical and is not related to the present invention, and thus will not be described in further details.

Figure 16:
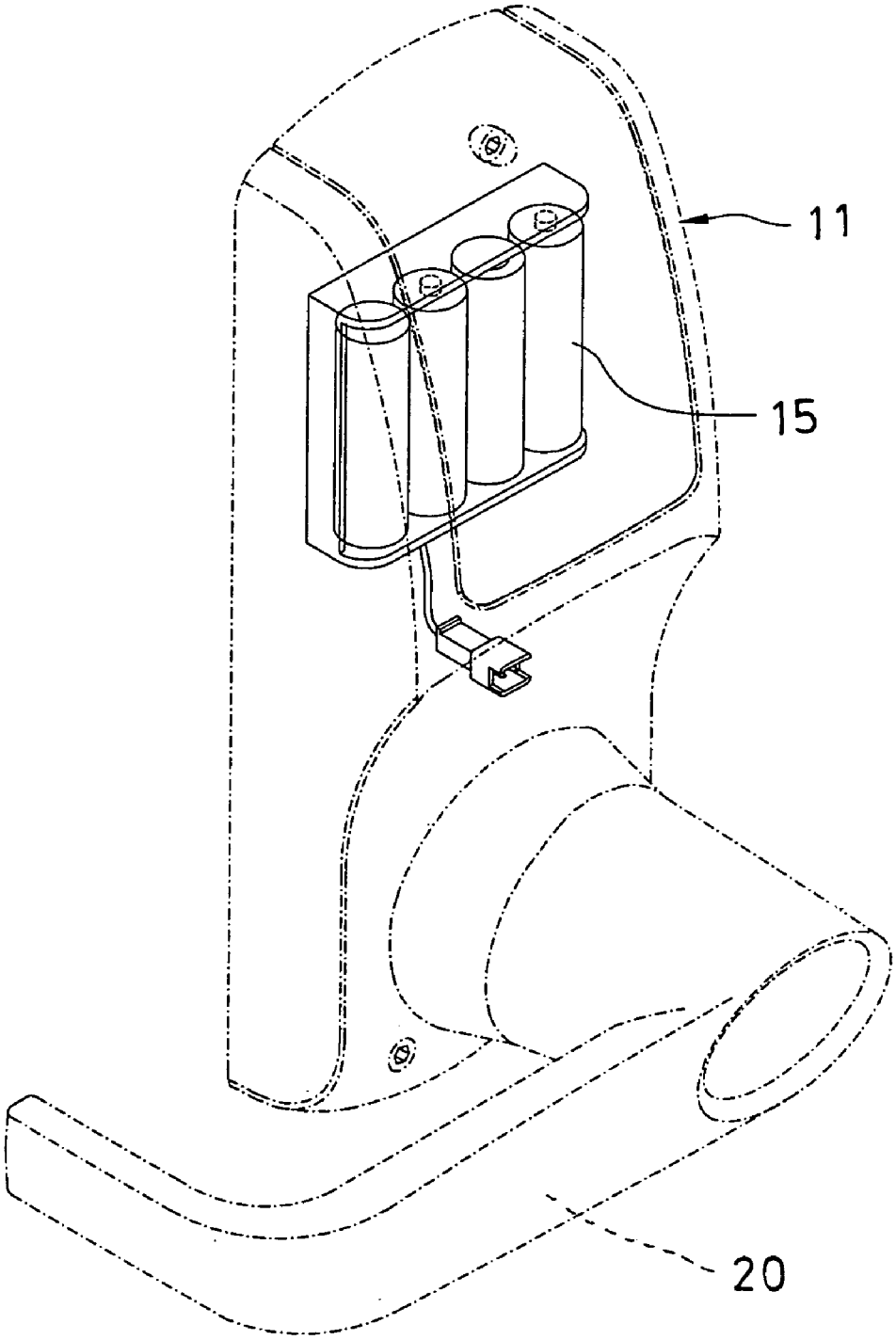
FIG. 16 is a partial perspective view illustrating an indoor handle device of the electric door lock.

The outer housing 10 includes a number of buttons 12 provided on the outer portion thereof and to be depressed or actuated by users, to enter predetermined passwords or secret codes into the electric door lock, and a circuit board 13 disposed therein to have control circuits (not shown) applied or provided thereon. The outer housing 10 may include a board 14 secured thereto with such as fasteners, and the board 14 may then be secured to the door panel 90 with such as fasteners. The inner housing 11 may include one or more batteries 15 disposed therein (FIG. 16) for energizing the electric elements or members or parts.

Figure 4:
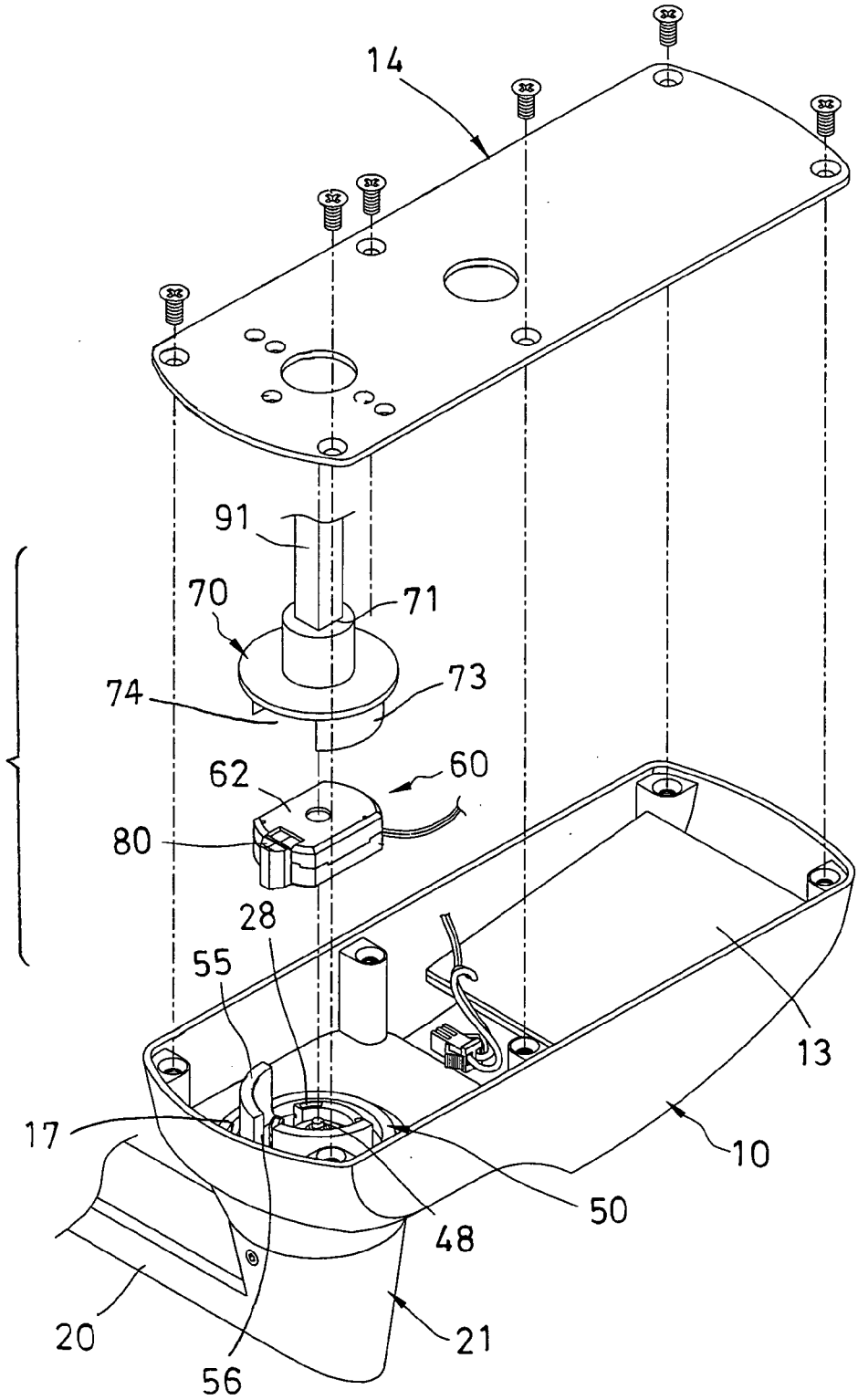
FIG. 4 is another partial exploded view of the electric door lock.
Figure 5:
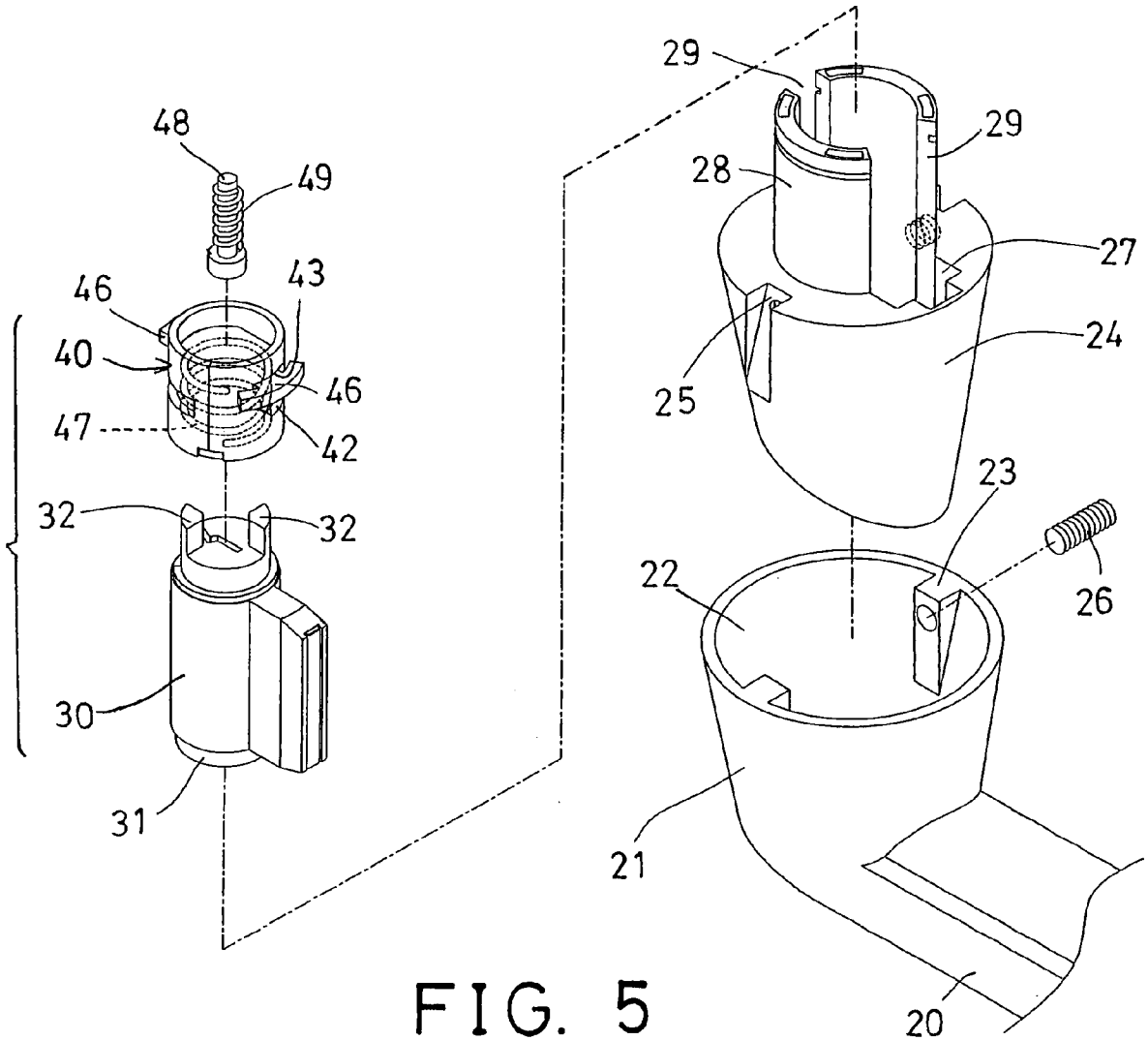
FIG. 5 is a further partial exploded view of the electric door lock.
Figure 6:
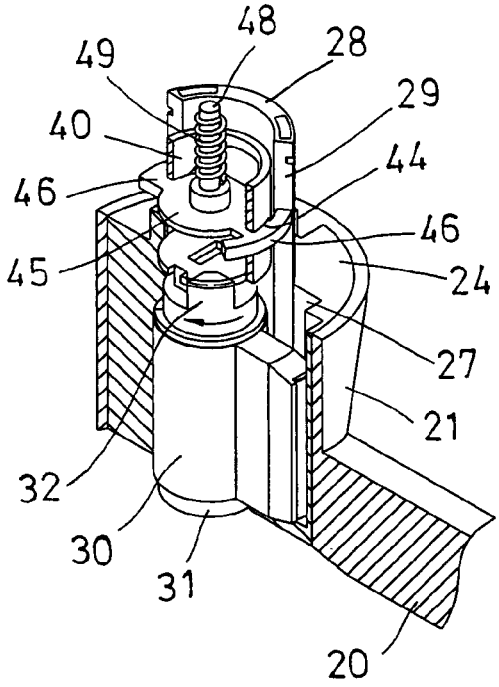
FIG. 6 is a partial perspective view showing an actuate handle of the electric door lock, in which a portion of the handle has been cut off to show the inner structure of the handle.
Figure 7:
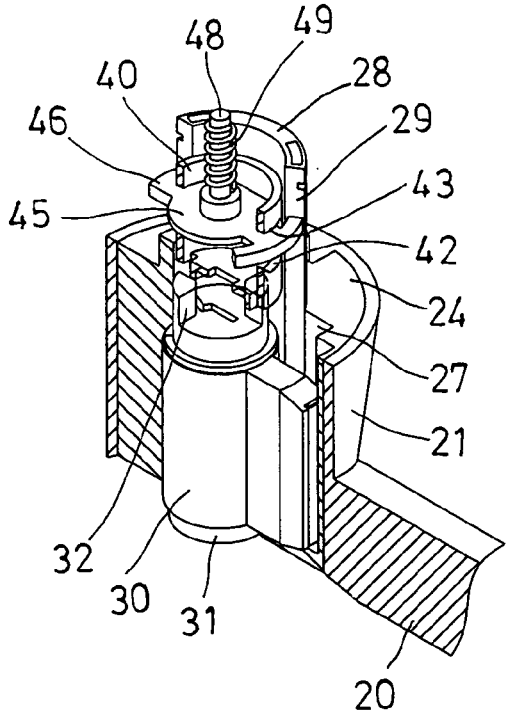
FIG. 7 is a partial perspective view similar to FIG. 6, illustrating the operation of the electric door lock.

Referring next to FIGS. 5–7, and again to FIGS. 3 and 4, the outer handle 20 includes a casing 21 having a chamber 22 formed therein and having one or more juts 23 extended into the chamber 22 thereof, and a block 24 engaged in the chamber 22 of the casing 21 and having one or more cavities 25 formed therein to receive the juts 23, and to anchor the block 24 in the casing 21. The block 24 may further be secured to the casing 21 with one or more fasteners 26. The block 24 includes a space 27 formed therein, and formed or defined by a tube 28 which is extended out beyond the block 24 and which includes one or more slots 29 formed therein.

Figure 5A:
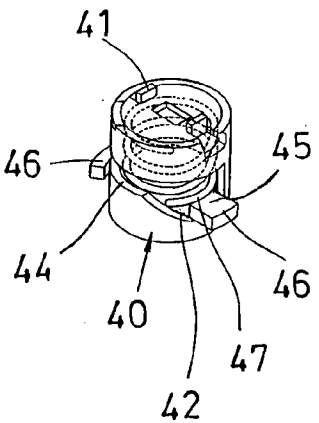
FIG. 5A is a bottom perspective view showing a control barrel for the lock device.
Figure 8:
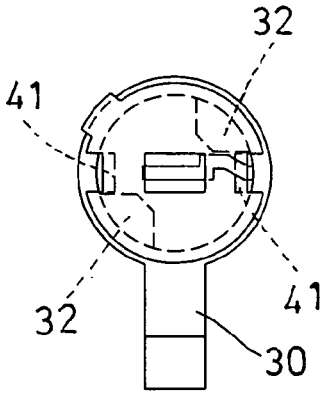
FIGS. 8, 9 are partial top plan schematic views showing the operation of the electric door locks as shown in FIGS. 6 and 7 respectively.
Figure 9:
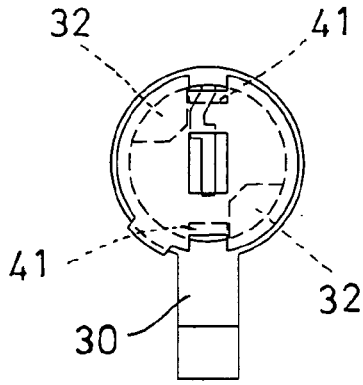
Figure 10:
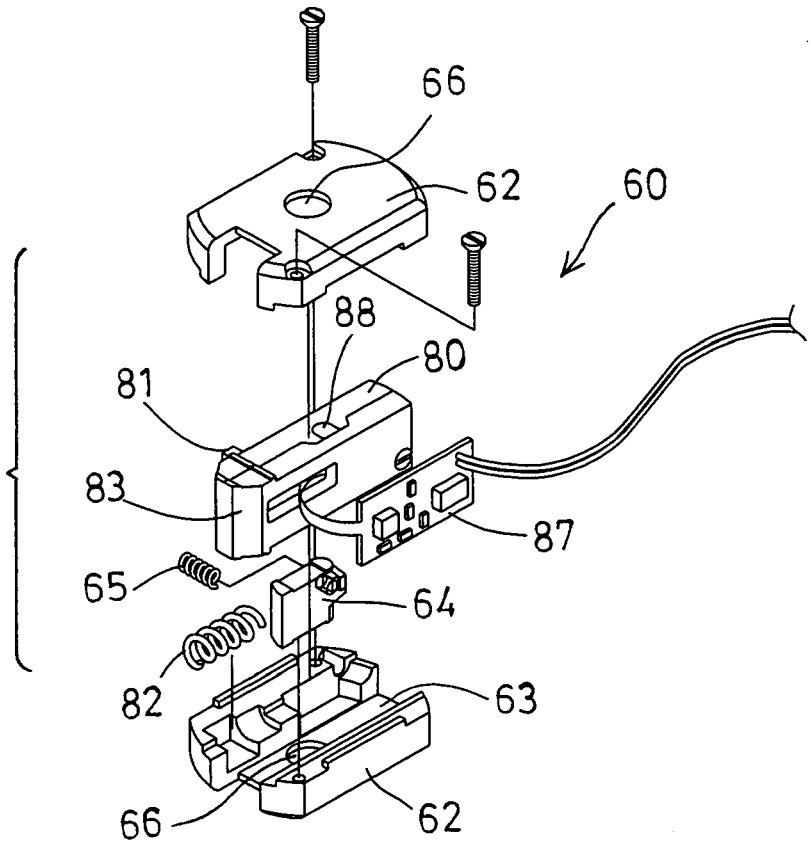
FIG. 10 is a partial exploded view of an electromagnetic control device of the electric door lock.
Figure 11:
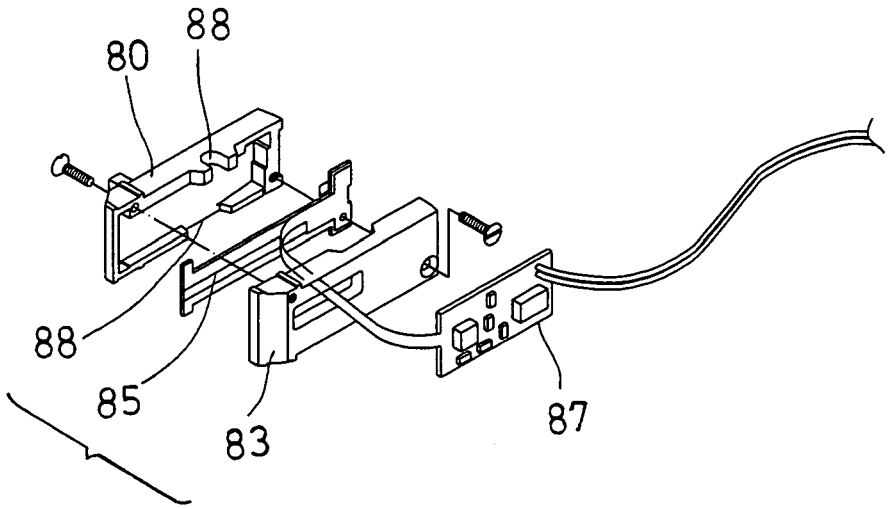
FIG. 11 is another partial exploded view of the electromagnetic control device of the electric door lock.
Figure 12:
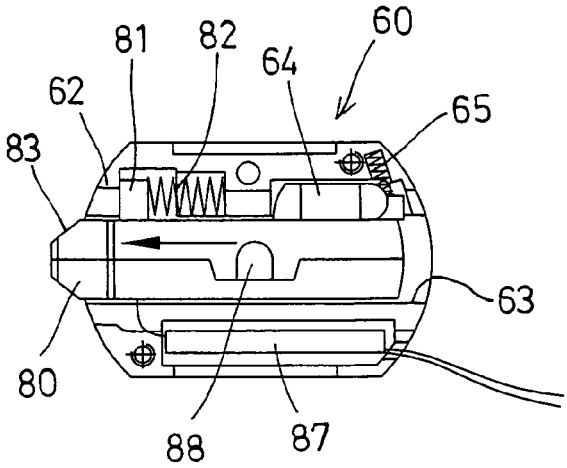
FIG. 12 is a top plan schematic view of the electromagnetic control device of the electric door lock, in which a portion of the electromagnetic control device has been cut off to show the inner structure of the electromagnetic control device.

A lock device 30 is engaged in the space 27 of the block 24 and secured to the block 24 with such as fasteners (not shown), and includes a core 31 rotatably received therein and having one or more actuating fingers 32 extended therefrom. A barrel 40 is rotatably and slidably received in the tube 28 of the block 24, and includes one or more projections 41 extended therefrom (FIGS. 5A, 8 and 9), for engaging with the actuating fingers 32 of the core 31 of the lock device 30 which may be used to rotate the barrel 40 relative to the tube 28 of the block 24.

As also shown in FIGS. 5A and 5–7, the barrel 40 includes one or more, such as a pair of inclined channels 42 formed therein, and a pair of higher seats 43 (FIGS. 5, 7) formed in one end of the inclined channels 42, and a pair of lower seats 44 (FIGS. 5A, 6) formed in the other end of the inclined channels 42 thereof. A bar 45 is slidably received in the inclined channels 42 of the barrel 40 and includes two ends 46 extended out of the barrel 40 and engaged in the slots 29 of the block 24, to anchor the bar 45 to the block 24, and to prevent the bar 45 from being rotated relative to the block 24.

Relatively, in operation, when the barrel 40 is rotated relative to the tube 28 of the block 24 by the core 31 of the lock device 30, the barrel 40 may also be caused or forced to be rotated relative to the bar 45, and the bar 45 may thus be forced to slide along the inclined channels 42 of the barrel 40, and may thus be seated in either the higher seats 43 (FIGS. 5, 7) or the lower seats 44 (FIGS. 5A, 6) of the barrel 40.

A coil spring 47 (FIGS. 5, 5A) may be engaged in the barrel 40 and engaged with the bar 45, to bias the bar 45 against the barrel 40, and to stably retain the bar 45 in either the higher seats 43 (FIGS. 5, 7) or the lower seats 44 (FIGS. 5A, 6) of the barrel 40. A catch 48 is secured to or extended from the bar 45 (FIGS. 6 and 7), and moved in concert with the bar 45, and a spring 49 may further be provided and engaged onto the catch 48.

Figure 3:
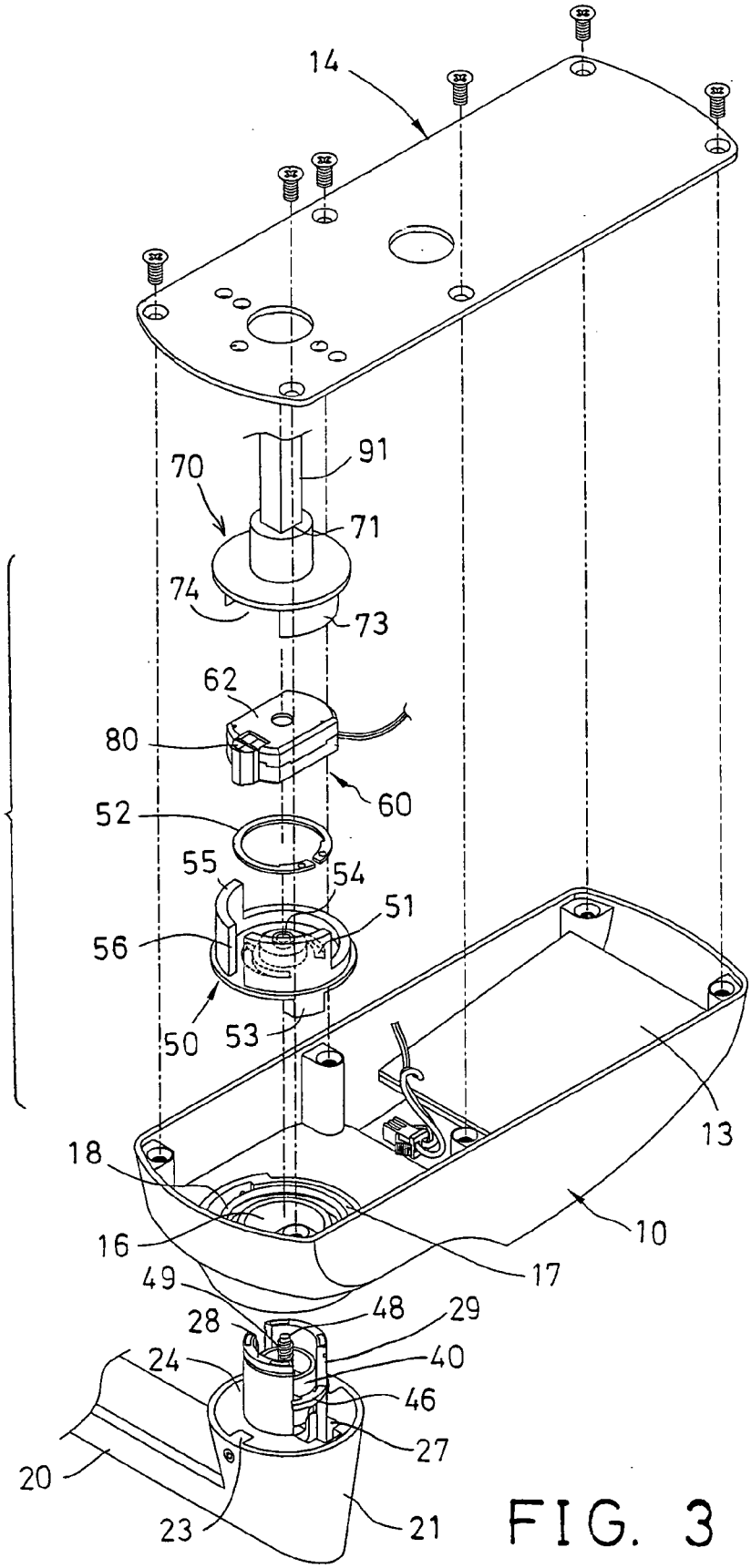
FIG. 3 is a partial exploded view of the electric door lock.

As shown in FIGS. 3 and 4, the outer housing 10 includes an orifice 16 formed therein to rotatably receive the tube 28 of the block 24, and includes a circular or peripheral groove 17 formed therein and arranged around the orifice 16 thereof, to receive a coil spring 18 therein.

A follower 50 includes a peripheral slot 51 formed therein to receive the tube 28 of the block 24, and to anchor the follower 50 to the block 24. The follower 50 may further be secured to the tube 28 of the block 24 with such as a retaining ring 52, and may include a leg 53 extended therefrom (FIG. 3) and slidably engaged in the circular or peripheral groove 17 of the housing 10. The spring 18 may engage with the leg 53 of the follower 50, to bias and to recover the follower 50 and the block 24 and the outer handle 20 relative to the housing 10.

Figure 2:
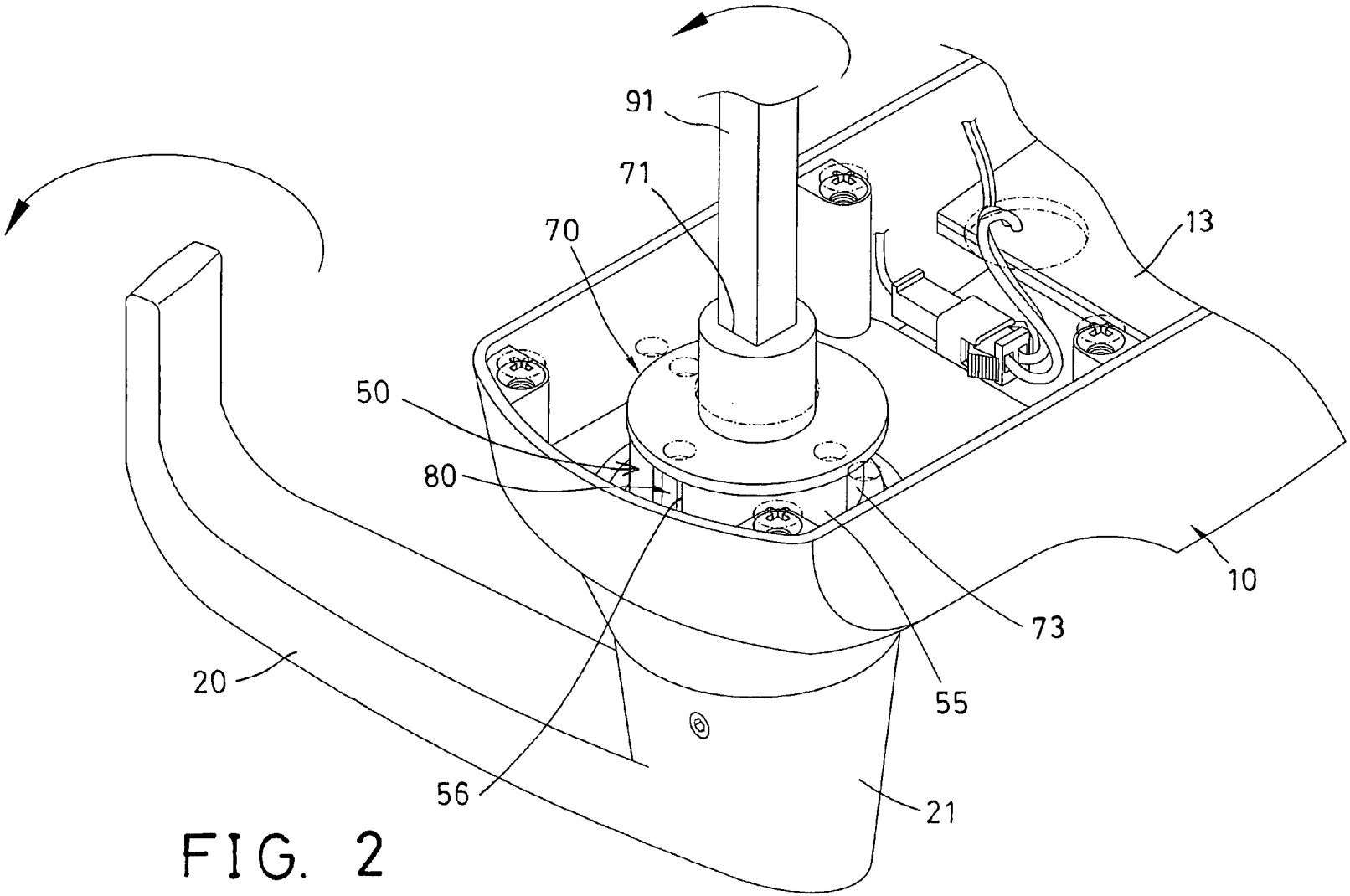
FIG. 2 is a partial perspective view of the electric door lock.

The follower 50 further includes a hole 54 formed therein (FIG. 3) to receive the catch 48. The spring 49 may thus be biased between the follower 50 and the bar 45. The follower 50 further includes a wall 55 provided thereon or extended therefrom and having a passage 56 formed therein. An electromagnetic control device 60 is rotatably engaged on or received in the wall 55, and includes a plunger 80 slidably received in a receptacle 62 and extendible to selectively engage into the passage 56 of the wall 55 of the follower 50 (FIG. 2).

A coupler 70 includes an aperture 71 formed therein to receive one end of the spindle 91, and includes a fence 73 extended therefrom to receive the electromagnetic control device 60, and to couple the electromagnetic control device 60 to the spindle 91, and thus to allow the electromagnetic control device 60 to be rotated in concert with the coupler 70 and the spindle 91. The coupler 70 includes an opening 74 formed in the fence 73 thereof to receive the plunger 80, and to allow the plunger 80 to selectively engage into the passage 56 of the wall 55 of the follower 50 (FIG. 2).

As shown in FIGS. 10–13, the electromagnetic control device 60 includes a pathway 63 formed in the receptacle 62 thereof, to slidably receive the plunger 80. The plunger 80 includes an extension 81 extended therefrom, and a spring 82 is engageable between the extension 81 of the plunger 80 and the receptacle 62 to bias the plunger 80 out of the receptacle 62, and thus to selectively engage into the passage 56 of the wall 55 of the follower 50.

Figure 14:
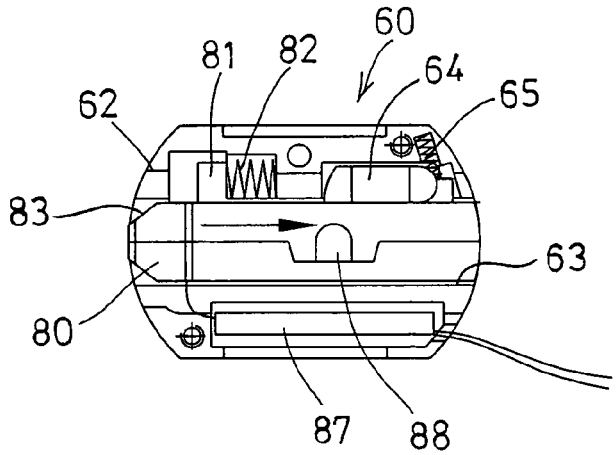
FIGS. 13, 14 are top plan schematic views similar to FIG. 12, illustrating the operation of the electromagnetic control device.
Figure 13:
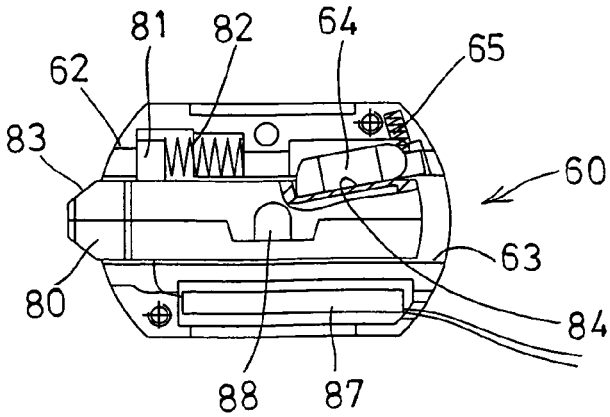
Figure 15:
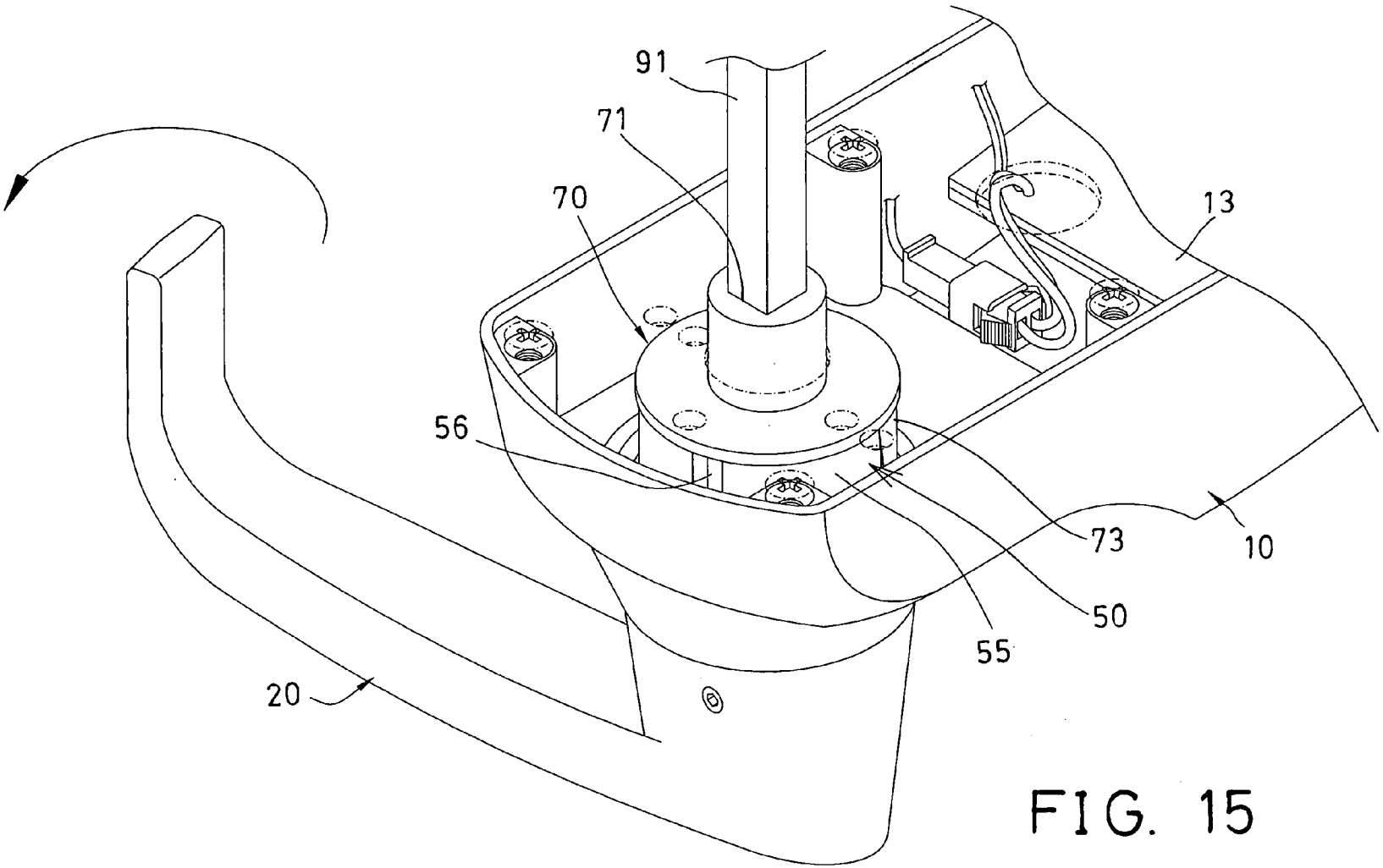
FIG. 15 is a partial perspective view similar to FIG. 2, illustrating the operation of the electric door lock.

The plunger 80 includes one or more, such as a pair of inclined surfaces 83 formed in the outer end or portion thereof, for engaging with the wall 55 of the follower 50, and for allowing the plunger 80 to be forced to move into the receptacle 62 against the spring 82 (FIG. 14) and to be disengaged from the passage 56 of the wall 55 of the follower 50 (FIG. 15) when the receptacle 62 of the electromagnetic control device 60 is rotated relative to the follower 50 by the spindle 91 and the coupler 70.

The plunger 80 includes a recess 84 formed therein. The electromagnetic control device 60 includes a latch 64 received in the receptacle 62 and engageable into the recess 84 of the plunger 80 (FIG. 13), to latch or lock or anchor the plunger 80 to the receptacle 62, and to prevent the plunger 80 from being moved into the receptacle 62. A spring 65 is also received in the receptacle 62 and engaged with the latch 64, to bias and to disengage the latch 64 from the recess 84 of the plunger 80 (FIGS. 12, 14), and thus to allow the plunger 80 to move relative to the receptacle 62.

The electromagnetic control device 60 further includes an electromagnetic member 85 received in such as the plunger 80, and coupled to a control circuit board 87 which may actuate the electromagnetic member 85 to generate an electromagnetic attracting force to attract or to force the latch 64 to engage into the recess 84 of the plunger 80 (FIG. 13), and to lock the plunger 80 to the receptacle 62.

The receptacle 62 includes a hole 66 formed therein, such as formed in the lower portion thereof. The plunger 80 includes a cavity 88 formed therein, and aligned with or exposable via the hole 66 of the receptacle 62, to allow the catch 48 to be selectively engaged into the cavity 88 of the plunger 80, and to lock or to couple the bar 45 to the plunger 80, and thus to prevent the plunger 80 from being moved into the receptacle 62.

In operation, when a correct password or secret code is entered into the control circuit board 87, the electromagnetic member 85 may be actuated or operated to generate an electromagnetic attracting force and to attract or to force the latch 64 to engage into the recess 84 of the plunger 80 (FIG. 13), and to lock the plunger 80 to the receptacle 62, and thus to prevent the plunger 80 from being moved into the receptacle 62.

At this moment, the plunger 80 is extended out of the receptacle 62 and engaged in the passage 56 of the wall 55 of the follower 50 (FIG. 2), such that the spindle 91 and the coupler 70 and the electromagnetic control device 60 may be coupled to the follower 50 and the block 24 and the handle 20, such that the spindle 91 may be rotated by the handle 20 to actuate the latchbolt 93 into the door panel 90, in order to open the door panel 90.

Similarly, when a correct key is engaged into the core 31 of the lock device 30, and when the barrel 40 is rotated relative to the tube 28 of the block 24 by the core 31 of the lock device 30, the bar 45 may be forced to slide to and to be seated in the higher seats 43 (FIGS. 5, 7) of the barrel 40, and to force the catch 48 to engage into the cavity 88 of the plunger 80, and thus to lock or couple or position the bar 45 to the plunger 80, and to prevent the plunger 80 from being moved into the receptacle 62.

At this moment, the plunger 80 is also extended out of the receptacle 62 and locked and engaged in the passage 56 of the wall 55 of the follower 50 (FIG. 2), such that the spindle 91 and the coupler 70 and the electromagnetic control device 60 may be coupled to the follower 50 and the block 24 and the handle 20, such that the spindle 91 may be rotated by the handle 20 to actuate the latchbolt 93 into the door panel 90, in order to open the door panel 90. The door panel 90 may thus be opened by the lock device 30 in addition to the electric lock device or structure formed by the electromagnetic control device 60 and the plunger 80.

On the contrary, when no correct passwords or secret codes have been entered into the control circuit board 87, the latch 64 will not be forced to engage into the recess 84 of the plunger 80, and when no correct keys have been engaged into the core 31 and to operate the core 31, the catch 48 will not be engaged into the cavity 88 of the plunger 80.

At these moments, the plunger 80 is freely to move into and out of the receptacle 62. When the handle 20 is rotated relative to the housing 10, the follower 50 may be rotated relative to the electromagnetic control device 60 by the handle 20, and the inclined surfaces 83 of the plunger 80 may be caused to be engaged with the wall 55 of the follower 50, to force the plunger 80 to move into the receptacle 62, such that the spindle 91 may not be rotated or operated by the handle 20 to open the door panel 90.

Accordingly, the electric door lock in accordance with the present invention is capable of being selectively opened by keys or by entering the correct passwords or secret codes into control circuits of the electric door locks.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An electric door lock comprising:

a housing, a handle rotatably attached to said housing, a lock device engaged in said handle, a follower received in said housing and secured to said handle, to rotatably secure said handle to said housing, an electromagnetic control device including a receptacle rotatably received in said following a plunger slidably engaged in said receptacle and extendible out of said receptacle to engage with said follower, and means for selectively latching said plunger to said receptacle, and to maintain an engagement of said plunger with said follower, and to allow said receptacle of said electromagnetic control device to be selectively latched to said follower with said selectively latching means, and means for selectively connecting said lock device to said plunger, to selectively latch said plunger to said receptacle, and to allow said receptacle of said electromagnetic control device to be selectively latched to said follower with said selectively connecting means.

2. The electric door lock as claimed in claim 1, wherein said follower includes a wall provided thereon and having a passage formed therein, said plunger is slidably engageable into said passage of said wall, to selectively anchor said plunger and said receptacle to said follower.

3. The electric door lock as claimed in claim 2 further comprising means for biasing said plunger to engage into said passage of said wall.

4. The electric door lock as claimed in claim 3, wherein said plunger includes at least one inclined surface formed therein to engage with said wall, and to allow said plunger to be moved away from said wall against said biasing means with an engagement of said at least one inclined surface of said plunger with said wall.

5. The electric door lock as claimed in claim 1 further comprising a coupler attached onto and rotated in concert with said receptacle of said electromagnetic control device, and a spindle attached to said coupler.

6. The electric door lock as claimed in claim 5, wherein said coupler includes a fence extended therefrom to receive said receptacle of said electromagnetic control device, and to couple said receptacle of said electromagnetic control device to said spindle, and said fence includes an opening formed therein to receive said plunger, and to allow said plunger to engage with said follower.

7. The electric door lock as claimed in claim 1, wherein said receptacle of said electromagnetic control device includes a latch received therein and engageable into said plunger, to selectively latch said plunger to said receptacle, and means for actuating said latch to engage into said plunger and to latch said plunger to said receptacle.

8. The electric door lock as claimed in claim 7, wherein said plunger includes a recess formed therein, to selectively receive said latch, and to allow said latch to be engaged into said recess of said plunger.

9. The electric door lock as claimed in claim 8, wherein said electromagnetic control device includes an electromagnetic member received in said plunger, and to be energized to attract said latch to engage into said recess of said plunger.

10. The electric door lock as claimed in claim 9, wherein said electromagnetic control device includes a control circuit board received in said receptacle and coupled to said electromagnetic member.

11. The electric door lock as claimed in claim 1, wherein said handle includes a space formed therein and defined by a tube, a barrel rotatably received in said tube and actuatable and rotatably by said lock device, and a catch received in said barrel and movable to selectively engage into said plunger when said barrel is rotated relative to said tube by said lock device.

12. The electric door lock as claimed in claim 11, wherein said barrel includes at least one projection extended therefrom, said lock device includes a core having at least one actuating finger extended therefrom, for engaging with said at least one projection of said barrel, to selectively rotate said barrel relative to said tube.

13. The electric door lock as claimed in claim 12, wherein said barrel includes a bar anchored therein and having said catch extended from said bar, and means for guiding said bar and said catch to move relative to said barrel, to selectively engage into said plunger when said barrel is rotated relative to said tube by said core of said lock device.

14. The electric door lock as claimed in claim 13, wherein said guiding means includes an inclined channel formed in said barrel, and a higher seat and a lower seat formed in ends of said inclined channel of said barrel, said bar is slidably engaged with said inclined channel of said barrel and engageable in either of said higher seat and said lower seat of said barrel.

15. The electric door lock as claimed in claim 14, wherein said tube of said handle includes at least one slot formed therein, said bar includes at least one end engaged in said at least one slot of said tube.

16. The electric door lock as claimed in claim 14 further comprising means for biasing said bar to engage with said barrel.

17. The electric door lock as claimed in claim 11 further comprising means for biasing said catch away from said plunger.

18. The electric door lock as claimed in claim 11, wherein said plunger includes a cavity formed therein to selectively receive said catch.

19. The electric door lock as claimed in claim 11, wherein said handle includes a casing, a block received in said casing and having said space formed therein to receive said lock device.

* * * * *